US011141644B2

(12) United States Patent
Clark

(10) Patent No.: US 11,141,644 B2
(45) Date of Patent: Oct. 12, 2021

(54) STABILIZER SYSTEM FOR GAMEBOARD

(71) Applicant: Crybaby Cornhole LLC, Asheville, NC (US)

(72) Inventor: Robert Clark, Asheville, NC (US)

(73) Assignee: Crybaby Cornhole LLC, Asheville, NC (US)

( * ) Notice: Subject to any disclaimer, the term of this patent is extended or adjusted under 35 U.S.C. 154(b) by 33 days.

(21) Appl. No.: 16/664,467

(22) Filed: Oct. 25, 2019

(65) Prior Publication Data

US 2020/0129835 A1 Apr. 30, 2020

Related U.S. Application Data

(60) Provisional application No. 62/750,441, filed on Oct. 25, 2018.

(51) Int. Cl.

| | |
|---|---|
| ***A63B 71/02*** | (2006.01) |
| ***A63B 67/06*** | (2006.01) |
| *A47B 91/02* | (2006.01) |

(52) U.S. Cl.

CPC ..... *A63B 71/023* (2013.01); *A63B 67/06* (2013.01); *A47B 91/02* (2013.01); *A63B 2071/024* (2013.01); *A63B 2225/055* (2013.01)

(58) Field of Classification Search

CPC . A63B 71/023–2071/024; A63B 67/06; A63B 2225/055; E04H 12/2215; F16M 7/00; A47C 7/008; A47B 91/02

See application file for complete search history.

(56) References Cited

U.S. PATENT DOCUMENTS

| | | | | |
|---|---|---|---|---|
| 2,088,518 | A * | 7/1937 | Hendricks | A47B 91/02 248/188.5 |
| 3,156,944 | A * | 11/1964 | Bohn | E05B 1/0015 16/412 |
| 3,489,411 | A * | 1/1970 | Morelli | A63B 69/0075 473/417 |
| 4,721,275 | A * | 1/1988 | Benton | F16M 7/00 248/188.4 |
| 5,067,727 | A | 11/1991 | Crompton | |
| 5,324,042 | A | 6/1994 | Demas | |
| 5,333,879 | A | 8/1994 | Barnes | |
| 5,575,483 | A | 11/1996 | Dineen et al. | |
| 6,244,598 | B1 | 6/2001 | Conville | |

(Continued)

*Primary Examiner* — Laura Davison

(74) *Attorney, Agent, or Firm* — William G. Heedy; The Van Winkle Law Firm

(57) ABSTRACT

A stabilizer system includes first and second base members each forming a passage; first and second rod members; each passage being sized for receipt of a corresponding one of the first and second rod members; each of the first and second base members forming a T-shaped receptacle; first and second barrel fasteners; each T-shaped receptacle being sized for selective engaged receipt of a corresponding one of the first and second barrel fasteners for securing the base members to corresponding ones of the first and second support legs of a target gameboard; first and second spike members each having a threaded tip; and each of the first and second rod members forming a threaded cavity that is sized for engaged receipt of the threaded tip of a respective one of the first and second spike members, wherein a second end of the spike member is sized for engaging the ground surface.

3 Claims, 6 Drawing Sheets

(56) References Cited

U.S. PATENT DOCUMENTS

| | | | | |
|---|---|---|---|---|
| 8,157,265 | B2 | 4/2012 | Conville et al. | |
| 10,010,780 | B2 * | 7/2018 | Potter ..... | A63B 69/3608 |
| 2018/0178100 | A1 | 6/2018 | Bunnell-Harvey | |

* cited by examiner

STABILIZER SYSTEM FOR GAMEBOARD

RELATED APPLICATION

This application claims priority to and incorporates entirely by reference U.S. Provisional Patent Application Ser. No. 62/750,441 filed on Oct. 25, 2018.

FIELD OF THE INVENTION

This invention relates to bean bag tossing games and, more particularly, an accessory stabilizer system for anchoring an associated target gameboard to the ground for improving bean bag tossing gameplay.

BACKGROUND OF THE INVENTION

Bean bag tossing games utilizing associated target gameboards is a popular game played recreationally and competitively around the world. Each target gameboard includes an inclined surface with a target opening sized for passage of bean bags. Generally, a target gameboard includes opposing legs hingedly secured to the gameboard at one end, wherein the legs are operable between a stowed position and a deployed position for gameplay. A common problem associated with playing bean bag tossing games is the irregularities resulting from movement of the target gameboard during gameplay.

Accordingly, there exists a need in the art for a stabilizer for anchoring target gameboards to the ground during bag-tossing gameplay.

SUMMARY OF THE INVENTION

In accordance with one form of the present invention, there is provided a stabilizer system for securing to the ground a target gameboard having opposing first and second support legs thereon, the stabilizer system including a first base member and a second base member; each of the first and second base members forming a passage; a first rod member and a second rod member; each passage being sized and configured for selective engaged receipt of a corresponding one of the first and second rod members; each of the first and second base members forming a T-shaped receptacle including a narrow passage extending from a flange cavity and an outer surface of the base member; a first barrel fastener and a second barrel fastener; each T-shaped receptacle being sized and configured for selective engaged receipt of a corresponding one of the first and second barrel fasteners for securing the first and second base members to corresponding ones of the first and second support legs; a first spike member and a second spike member, each of the first and second spike members having a threaded tip at a first end of the spike member; each of the first and second rod members forming a threaded cavity that is sized and configured for engaged receipt of the threaded tip of a respective one of the first and second spike members, and wherein a second end of the spike member is sized and configured for engaging the ground surface; a first tightening member and a second tightening member, each of the first and second tightening members including a knob and a blunt end at opposing ends of a threaded shaft; and each of the first and second base members forming a channel sized and configured for engaged receipt of a respective one of the first and second tightening members, and wherein the knob may be selectively rotated to bring the blunt end into abutment with the rod member for securing the rod member to base member.

In accordance with another form of the present invention, there is provided a stabilizer system for securing to the ground a target gameboard having opposing first and second support legs thereon, the stabilizer system including a first base member and a second base member; each of the first and second base members forming a passage; a first rod member and a second rod member; each passage being sized and configured for selective engaged receipt of a corresponding one of the first and second rod members; each of the first and second base members forming a T-shaped receptacle including a narrow passage extending from a flange cavity and an outer surface of the base member; a first barrel fastener and a second barrel fastener; each T-shaped receptacle being sized and configured for selective engaged receipt of a corresponding one of the first and second barrel fasteners for securing the first and second base members to corresponding ones of the first and second support legs; a first spike member and a second spike member, each of the first and second spike members having a threaded tip at a first end of the spike member; and each of the first and second rod members forming a threaded cavity that is sized and configured for engaged receipt of the threaded tip of a respective one of the first and second spike members, and wherein a second end of the spike member is sized and configured for engaging the ground surface.

In accordance with another form of the present invention, there is provided a stabilizer system for securing to the ground a target gameboard having opposing first and second support legs thereon, the stabilizer system including a first base member and a second base member; each of the first and second base members forming a passage; a first rod member and a second rod member; each passage being sized and configured for selective engaged receipt of a corresponding one of the first and second rod members; each of the first and second base members being selectively securable to corresponding ones of the first and second support legs; a first spike member and a second spike member, each of the first and second spike members having a threaded tip at a first end of the spike member; a first suction cup member and a second suction cup member, each of the first and second suction cup members having a threaded end at a first end of the suction cup member; each of the first and second rod members forming a threaded cavity; and wherein the threaded cavity is sized and configured for selective engaged receipt of one of either the threaded tip of a respective one of the first and second spike members, wherein a second end of the spike member is sized and configured for engaging the ground surface, or the threaded end of a respective one of the first and second suction cup members, wherein a suction cup at a second end of the suction cup member is structured and disposed for securing to the ground surface.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the stabilizer system of the present invention for use in conjunction with a target gameboard 100 having first and second support legs 102A and 102B thereon is shown and described herein and is generally indicated as 10.

Figure 1:
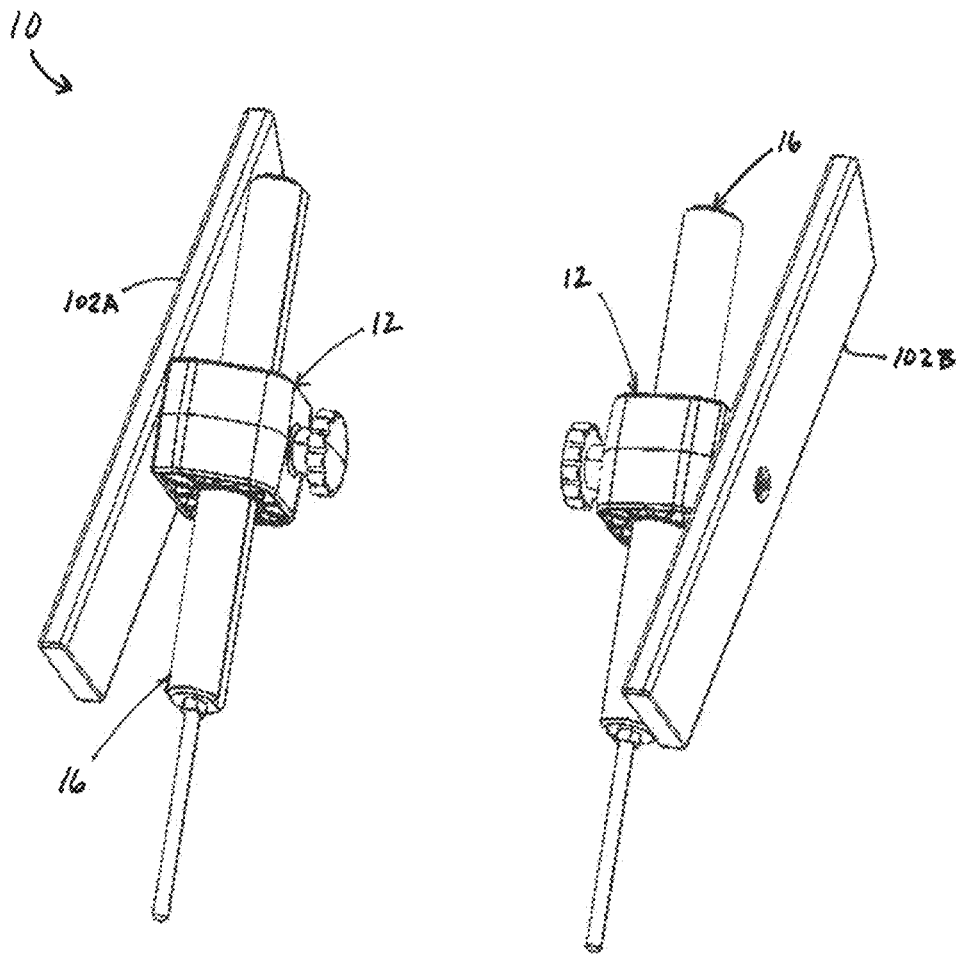
FIG. 1 is perspective view of the stabilizer system of the present invention in accordance with one embodiment, illustrating respective base members affixed to opposing legs of a gameboard (not shown for clarity)
Figure 2:
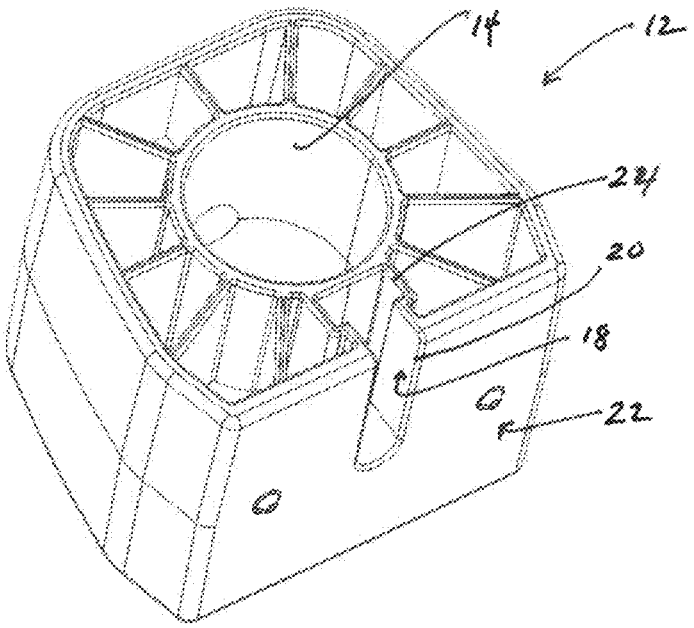
FIG. 2 is a perspective view of a base member.
Figure 3:
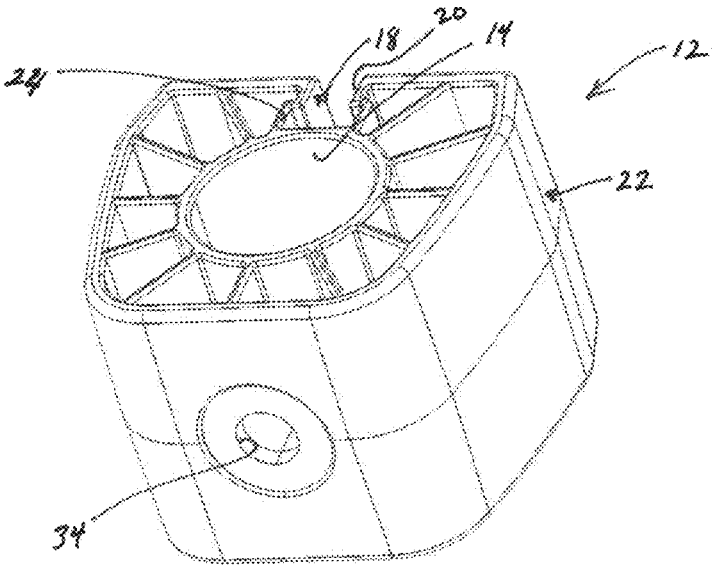
FIG. 3 is another perspective view thereof.

As shown in FIG. 1, the stabilizer system 10 includes first and second base members 12. With reference to FIGS. 2 and 3, each base member 12 forms a passage 14 extending the length of the base member 12. Each passage 14 is sized and configured for engaged receipt of a rod member 16 (see FIG. 6).

Figure 4:
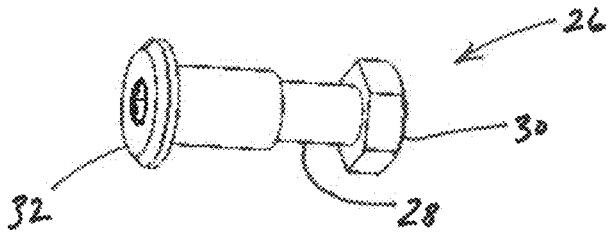
FIG. 4 is a perspective view of a binding barrel.
Figure 10:
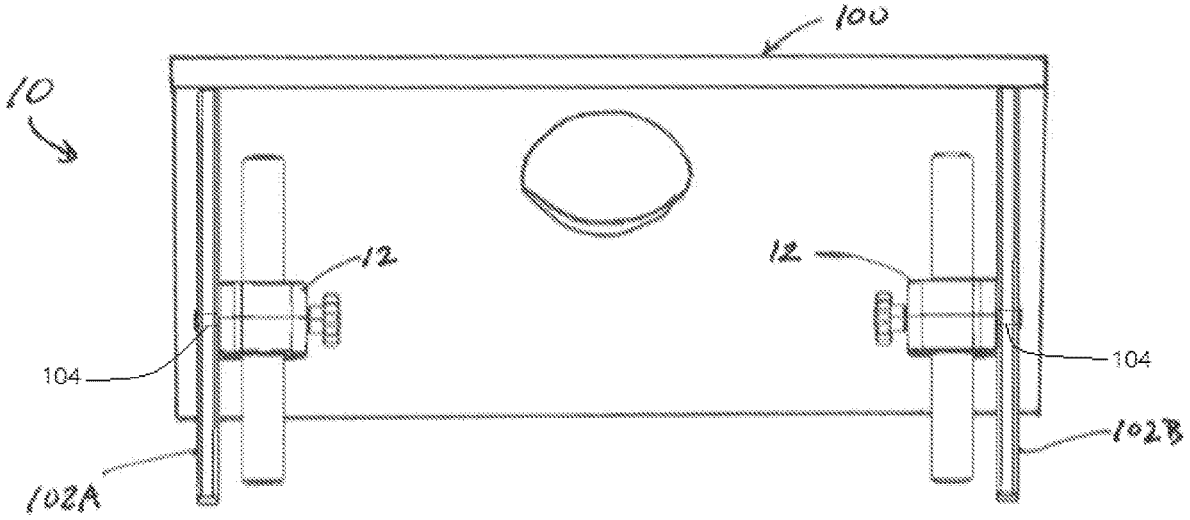
FIG. 10 is a rear elevational view of a gameboard illustrating respective base members affixed to opposing legs thereof.

Each base member 12 may be selectively attached to a respective one of the first and second support legs 102A and 102B of the gameboard 100 (see FIG. 10). In one embodiment, a T-shaped receptacle 18 is formed on the base member 12, the T-shaped receptacle 18 including a narrow passage 20 extending from the outer surface 22 of the base member 12 and a flange cavity 24. A barrel fastener 26, shown in FIG. 4, includes an elongate shaft 28 that is sized and configured for snug fit engagement in the narrow passage 20 of the T-shaped receptacle 18, a flanged end 30 sized and configured for snug fit engagement in the flange cavity 24 of the T-shaped receptacle 18, and an opposite end 32 for securing to a respective one of the first and second support legs 102A and 102B through an aperture 104, for selectively attaching a base member 12 to a respective one of the first and second support legs 102A and 102B.

Figure 5:
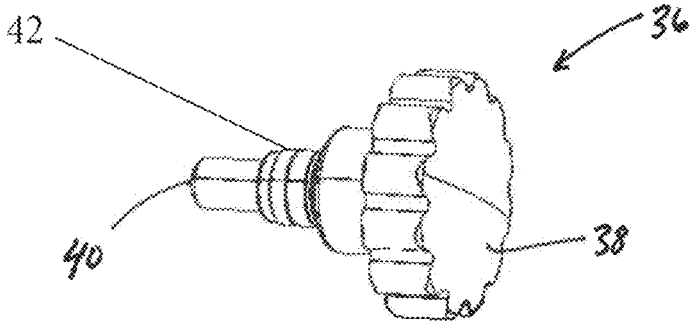
FIG. 5 is a perspective view of a tightening member.

Still referring to FIGS. 2 and 3, each base member 12 may form a channel 34 sized and configured for engaged receipt of a tightening member 36. Referring to FIG. 5, in one embodiment, the tightening member 36 includes a knob 38 and a blunt end 40 on opposing ends of a threaded shaft 42. In operation, the knob 38 of the tightening member 36 may be selectively rotated to bring the blunt end 40 into abutment with the rod member 16 for securing the rod member 16 to base member 12.

Figure 6:
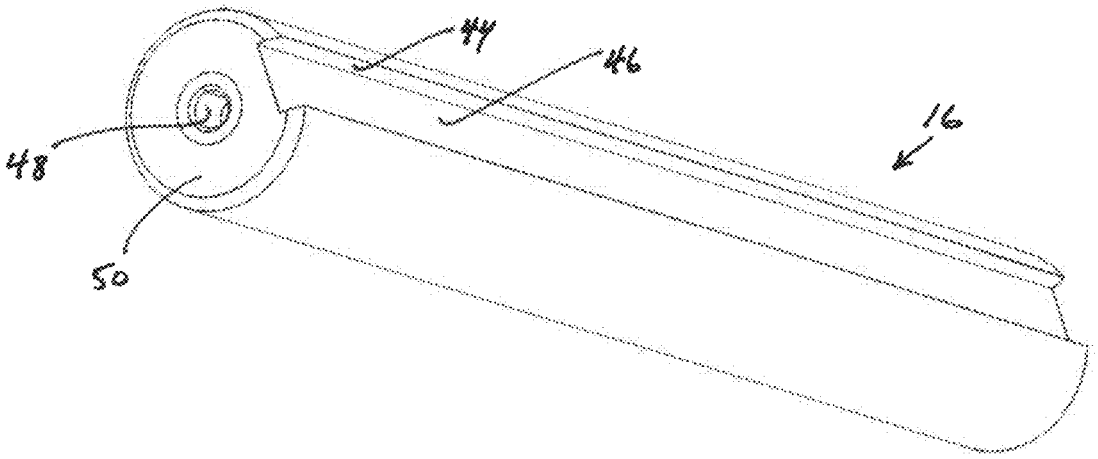
FIG. 6 is a perspective view of a rod member.
Figure 7:
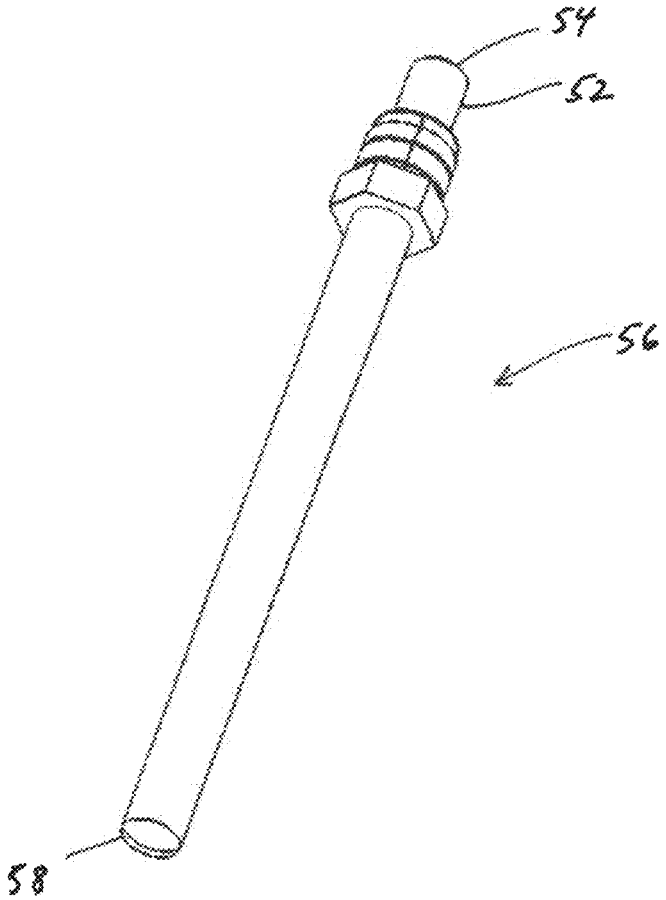
FIG. 7 is a perspective view of a spike member.

Now referring to FIG. 6, the rod member 16 may form a groove 44 sized for receipt of the blunt end 40 of the tightening member 36. The recessed surface 46 of the groove 44 prevents rotation of the rod member 16 when the blunt end 40 of the tightening member 36 is brought into abutment with the recessed surface 46.

Still referring to FIG. 6, the rod member 16 may form a threaded cavity 48 at a bottom end 50. The threaded cavity 48 is sized for engaged receipt of a threaded tip 52 of a first end 54 of a spike member 56. A second end 58 of the spike member 56 is sized and configured for engaging a ground surface, such as grass, dirt, sand or a pre-drilled hole, for securing the respective base member 12 to the ground surface. After each of the respective base members 12 are secured to the ground surface and the corresponding support legs 102A and 102B of the gameboard 100, the gameboard 100 is effectively secured to the ground surface for gameplay.

Figure 8:
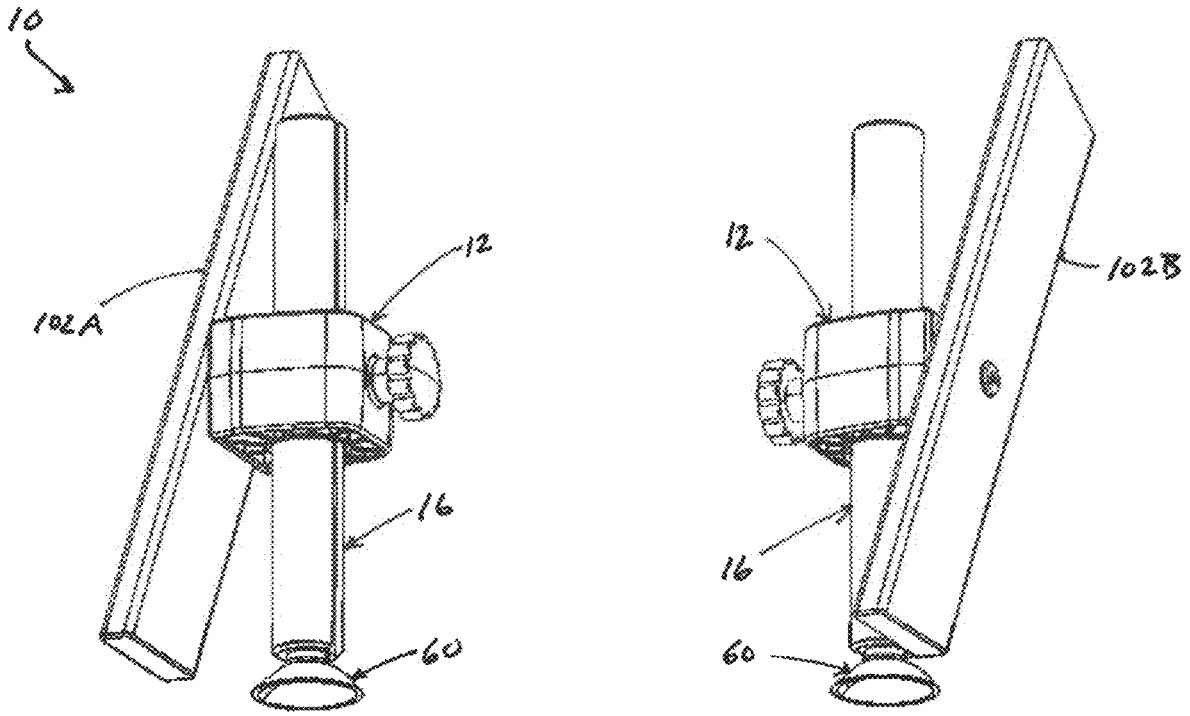
FIG. 8 is a perspective view of the stabilizer system of the present invention in accordance with one embodiment, illustrating respective base members affixed to opposing legs of a gameboard (not shown for clarity)
Figure 9:
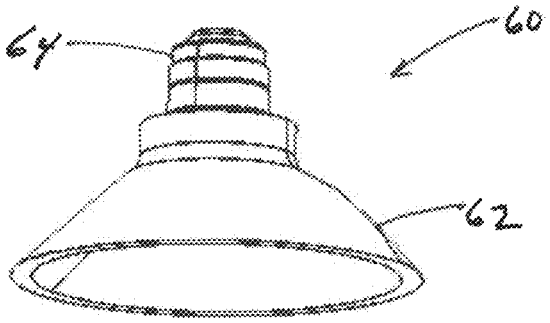
FIG. 9 is a perspective view of the suction cup member.

Now referring to FIGS. 8 and 9, and in accordance with one embodiment, the stabilizer system 10 includes a suction cup member 60. The suction cup member 60 includes a suction cup 62 and a threaded end 64 that is sized for engagement of the threaded cavity 48 formed on the bottom end 50 of the rod member 16. The suction cup 62 is structured and disposed for attachment to a ground surface, such as a tile floor, concrete floor or hardwood floor, for securing the respective base member 12 to the ground surface.

Referring to FIG. 10, the support legs 102A and 102B may be folded underneath the gameboard 100 for storage with the stabilizer system 10 secured to the support legs 102A and 102B.

While the present invention has been shown and described in accordance with several preferred and practical embodiments, it is recognized that departures from the instant disclosure are contemplated within the spirit and scope of the present invention.

What is claimed is:

1. A stabilizer system for securing to a ground surface a target gameboard having opposing first and second support legs thereon, the stabilizer system comprising:

a first base member and a second base member;

each of the first and second base members forming a passage;

a first rod member and a second rod member;

each passage being sized and configured for selective engaged receipt of a corresponding one of the first and second rod members;

each of the first and second base members forming a T-shaped receptacle including a narrow passage extending from a flange cavity and an outer surface of the base member;

a first barrel fastener and a second barrel fastener;

each of the first and second barrel fasteners being sized and configured for secured engagement through an aperture formed by corresponding ones of the first and second support legs;

each T-shaped receptacle being sized and configured for selective receipt of a corresponding one of the first and second barrel fasteners for removably securing the first and second base members to corresponding ones of the first and second support legs;

a first spike member and a second spike member, each of the first and second spike members having a threaded tip at a first end of the corresponding spike member;

each of the first and second rod members forming a threaded cavity that is sized and configured for engaged receipt of the threaded tip of a respective one of the first and second spike members, and wherein a second end of the spike member is sized and configured for engaging the ground surface;

a first tightening member and a second tightening member, each of the first and second tightening members including a knob and a blunt end at opposing ends of a threaded shaft; and each of the first and second base members forming a channel sized and configured for engaged receipt of a respective one of the first and second tightening members, and wherein the knob may be selectively rotated to bring the blunt end into abutment with the rod member for securing the rod member to base member.

2. The stabilizer system as recited in claim 1 wherein the rod member forms a groove having a recessed surface that is sized and configured for receipt of the blunt end of the tightening member.

3. A stabilizer system for securing to a ground surface a target gameboard having opposing first and second support legs thereon, the stabilizer system comprising:

a first base member and a second base member;

each of the first and second base members forming a passage;

a first rod member and a second rod member;

each passage being sized and configured for selective engaged receipt of a corresponding one of the first and second rod members;

each of the first and second base members forming a T-shaped receptacle including a narrow passage extending from a flange cavity and an outer surface of the base member;

a first barrel fastener and a second barrel fastener;

each of the first and second barrel fasteners being sized and configured for secured engagement through an aperture formed by corresponding ones of the first and second support legs;

each T-shaped receptacle being sized and configured for selective receipt of a corresponding one of the first and second barrel fasteners for removably securing the first and second base members to corresponding ones of the first and second support legs;

a first spike member and a second spike member, each of the first and second spike members having a threaded tip at a first end of the corresponding spike member; and each of the first and second rod members forming a threaded cavity that is sized and configured for engaged receipt of the threaded tip of a respective one of the first and second spike members, and wherein a second end of the spike member is sized and configured for engaging the ground surface.

* * * * *